US006916237B2

(12) United States Patent
Lee

(10) Patent No.: US 6,916,237 B2
(45) Date of Patent: Jul. 12, 2005

(54) COIN SORTING APPARATUS

(75) Inventor: Jong Suk Lee, Siheung-si (KR)

(73) Assignee: Royal Sovereign Inc., Incheon-si (KR)

( * ) Notice: Subject to any disclaimer, the term of this patent is extended or adjusted under 35 U.S.C. 154(b) by 72 days.

(21) Appl. No.: 10/350,109

(22) Filed: Jan. 24, 2003

(65) Prior Publication Data

US 2004/0097183 A1 May 20, 2004

(30) Foreign Application Priority Data

Nov. 20, 2002 (KR) ..... 10-2002-0072374

(51) Int. Cl.[7] ..... G07D 3/00; G07D 9/02
(52) U.S. Cl. ..... 453/13
(58) Field of Search ..... 453/3, 13, 61, 453/63, 12; 193/DIG. 1; 194/350, 351

(56) References Cited

U.S. PATENT DOCUMENTS 1,159,771 A * 11/1915 Johnson et al. ..... 235/32
6,443,829 B1 * 9/2002 Perkitny ..... 453/9
2004/0029517 A1 * 2/2004 Perkitny ..... 453/13
2004/0097181 A1 * 5/2004 Perkitny ..... 453/3

* cited by examiner

*Primary Examiner*—Donald P. Walsh
*Assistant Examiner*—Mark J Beauchaine
(74) *Attorney, Agent, or Firm*—McKenna Long & Aldridge LLP

(57) ABSTRACT

There is provided a coin sorting apparatus having a coin receiving device for allowing an easy receipt of coins according to the size of the coins while the sorting of coins is being processed, the coin sorting apparatus including a coin sorting means for separating and sorting coins according to the respective size of coins; a guide for directing sorted coins separated according to the size in the coin sorting means to a predetermine location; a coin receiving tube located adjacent to the lower end of the guide for receiving coins; a tube receiving container which at least one coin receiving tube for the same size of coins is equipped in, and which has a sliding protrusion on the lower side of the tube receiving container for moving the tube receiving container back and forth within a predetermined distance; and a sliding member located under the tube receiving container, and having a sliding groove on the upper side of the sliding member being coupled with the tube receiving container so that the tube receiving container slidably moves back and forth.

20 Claims, 15 Drawing Sheets

COIN SORTING APPARATUS

BACKGROUND OF THE INVENTION

1. Field of the Invention

The present invention relates to a coin sorting apparatus, and more particularly, to a coin sorting apparatus in which coins are sorted according to the size of them while the coins are thrown through a coin slot.

2. Description of the Related Art

Generally, a coin sorting apparatus indicates a machine for separating and sorting a large amount of coins according to the respective size of coins within a short time, and it is widely used in financial institutions such as banks or business commerce to quickly and exactly sort coins.

FIG. 1 is a perspective view showing the appearance of a conventional typical coin sorting apparatus.

Referring to FIG. 1, the conventional typical coin sorting apparatus includes a coin slot 10 through which a large amount of coins are thrown, a guide 30 for allowing the coins, which are thrown through the coin slot 10 to be sorted and received according to the size of the coins, a coin receiving tube 40 for receiving the coins carried through the guide 30 at a predetermined amount, a fallen-coin drawer 50 for collecting the coins, which are not received in the coin receiving tube 40, and a power switch 60 for supplying or shutting off a power to the coin sorting apparatus.

Hereinafter, the operation of the coin sorting apparatus structured as above is described briefly. If a user turns on the power switch 60, and supplies coins into the coin slot 10, the coins are sorted by a sorting unit located below the coin slot 10, and discharged through the guide 30.

The coins discharged through the guide 30 are stacked in the coin receiving tube 40. In case the coin receiving tube 40 is made in a two-stage structure as shown in FIG. 1, the coins are received in the coin receiving tube 40 adjacent to the guide 30.

When the coin receiving tube 40 adjacent to the guide 30 is filled with coins, the coins are received in another coin receiving tube 40.

If the coin receiving tube 40 is filled with coins, a user turns off the power switch 60, and takes out the coin receiving tube 40 to use the coins.

FIG. 2 is a sectional view of a conventional typical coin sorting apparatus to illustrate the inside of the coin sorting apparatus.

Referring to FIG. 2, the coin sorting apparatus includes a coin slot 10 through which coins are thrown, a supply control container 11 for controlling the supply amount of the coins thrown through the coin slot 10 such that the coins are supplied into a separating unit by a small amount, a supply hole 12 formed on a sidewall of the supply control container 11, and allowing a small amount of coins to be thrown, a cover 15 for preventing the coins from coming out of the supply control container 11 while the supply control container 11 is rotated, a carrier container 13 for carrying the coins thrown through the supply hole 12 such that the coins are separated and sorted by a carrier hole 14 and a separation hole 16, and a rotation shaft 18 and a motor 17 for rotating the supply control container 11 and the carrier container 13.

In addition, the coin sorting apparatus further includes a guide 30 for guiding the coins sorted by the separation hole 16 for a receipt of the coins, a coin receiving tube 40 for receiving the coins carried out through the guide 30, a tube receiving container 41 for receiving the coin receiving tube 40, and a fallen-coin drawer 50 for receiving the coins, which are not received in the coin receiving tube 40 and are fallen down.

The operation of the conventional coin sorting apparatus structured as above is described. If a large amount of coins are supplied into the coin slot 10, the coins are received in the supply control container 11. Then, a small amount of coins are put into the carrier container 13 through the supply hole 12 formed on the side wall of the supply control container 11 as the supply control container 11 is rotated.

The coins, which are put into the carrier container 13, are inserted into the carrier hole 14 formed on the carrier container 13 while the carrier container 13 is rotated, and then, the coins are moved into the separation hole 16 along with the carrier container 13 rotated.

The separation hole 16 is provided with a plurality of holes having different size, and the separation holes 16 are provided in an order from the small size to the big size according to the rotation direction of the carrier hole 14.

Therefore, small sizes of coins are discharged through the separation hole 16, and then, the biggest sizes of coins are finally discharged through the separation hole 16.

The rotation of the supply control container 11 and the carrier container 13 are performed by the rotation shaft 18 and the motor 17 placed under the carrier container 13.

The sorted coins passing through the separation hole 16 are carried along the guide 30, and received in the coin receiving tube 40.

The coin receiving tube 40 can be provided by one every size of coins, or as shown in the drawings, the coin receiving tube 40 can be provided by two having the same size every size of coins.

If the two coin receiving tubes 40 are all filled up with coins, coins are now fallen down and received in the fallen-coin drawer 50.

After the sorting of coins is completed, a user can take out the coin receiving tube 40 and get a desired kind of coins.

FIGS. 3 and 4 are views of the conventional coin sorting apparatus with a withdrawal assembly of the coin receiving tube illustrated.

Referring to FIGS. 3 and 4, the conventional coin sorting apparatus includes a motor 17 for generating a power, a rotation shaft 18 for transferring the rotation force generated by the motor 17, a supply control container 11 figured to be concaved at its center and having a supply hole 12 on its side such that a predetermined amount of coins are supplied during its rotation, a cover 15 coupled with the upper side of the supply control container 11 and having a coin slot 10 at its center, for preventing the coins inside the supply control container 11 from escaping, a carrier container 13 provided under the supply control container 11 and having a carrier hole 14 such that the coins are placed in ones, a plurality of separation holes 16 having different size respectively such that the coins carried by the carrier hole 14 are sorted, a guide 30 for guiding a receipt of the coins sorted by the separation holes 16 to a predetermined location, a coin receiving tube 40 for receiving the coins fallen down from the guide 30, a tube receiving container 41 for receiving the coin receiving tube 40, a fallen-coin drawer 50 for collecting the fallen coins, which are not received in the coin receiving tube 40, a slope member 51 which is integrally formed with the fallen-coin drawer 50 and has a sloping surface so that the tube receiving container 41 moves, a roller 44 provided on the lower side of the tube receiving container 41 so that the tube receiving container 41 easily moves along the sloping surface of the slope member 51, and a micro switch 54 provided on the back of the slope member 51 and turning on and off a power switch according to the contact-on/off with the slope member 51.

In addition, a protrusion 42 is provided inside the tube receiving container 41 and a groove 43 is provided on the inner wall of the coin sorting apparatus so that the tube receiving container 41 moves up and down when the slope member 51 moves back and forth.

Operation of the withdrawal assembly of the coin receiving tube in the conventional coin sorting apparatus structured as above is described. If a large amount of coins are supplied into the coin slot 10, the coins are received in the supply control container 11. Then, a small amount of coins are put into the carrier container 13 through the supply hole 12 formed on the side wall of the supply control container 11 as the supply control container 11 is rotated.

The coins, which are put into the carrier container 13, are inserted into the carrier hole 14 formed on the carrier container 13 while the carrier container 13 is rotated, and then, the coins are sorted through the separation hole 16 with the carrier container 13 rotated, and are received in the coin receiving tube 40 along the guide 30.

The coins, which are not received in the coin receiving tube 40, are fallen down in the fallen-coin drawer 50, and a shield film 52 prevents coins from coming out of the coin sorting apparatus.

When the sorting of coins is completed, and if a user turns off a power switch, or pulls out the fallen-coin drawer 50, the slope member 51 connected to the back of the fallen-coin drawer 50 is moved whereby the slope member 51 and the micro switch 54 are detached so as to turn off a power switch.

Since the slope member 51 moves in the same direction as the fallen-coin drawer 50, the tube receiving container 41 moves up along the sloping surface of the slope member 51 with little friction force by the roller 44.

In other words, since the protrusions 42 formed on the both sides of the tube receiving container 41 are coupled with the groove 43 formed on the inner wall of the coin sorting apparatus, the tube receiving container 41 moves just up and down without back and forth movement when the slope member 51 moves.

In other words, if the slope member 51 moves up, the power switch is turned off and the tube receiving container 41 moves up.

FIG. 4 illustrates that the tube receiving container 41 moves up along the sloping surface of the slope member 51, and the power switch is turned off with the micro switch 54 and the slope member 51 detached.

FIG. 5 is a perspective view showing that the power switch is turned off with the fallen-coin drawer pulled out, and the tube receiving container moves up by the slope member.

Referring to FIG. 5, as described in FIGS. 3 and 4, if the fallen-coin drawer 50 is pulled out, the power switch is turned off, and the tube receiving container 41 moves up so that a user can take out the coin receiving tube 40 mounted on the tube receiving container 41.

In the case that the coin receiving tubes 40 are provided very closely and in two arrays as illustrated in the drawings, since all of the coin receiving tubes 40 are raised up together, it will be difficult to take out the coin receiving tube 40 from the tube receiving container 41.

Especially, it will be more difficult to take out the coin receiving tube 40 by big fingers or with gloves put on.

FIG. 6 is a schematic view for illustrating a principle that coins are received into the coin receiving tube in the conventional coin sorting apparatus.

Referring to FIG. 6, the conventional coin sorting apparatus uses a free-fall principle by gravity whereby the sorted coins carried along the guide 30 are stacked in the coin receiving tube 40*a* adjacent to the guide 30 first, and if the coin receiving tube 40*a* is filled up with coins, coins are fallen down into a next coin receiving tube 40*b*.

In other words, by using the same principle as overflowing of water, the same size of coins are received in at least one coin receiving tube 40.

As described above, the conventional coin receiving tube 40 allows the sorted coins to be fallen down from the guide 30 into the coin receiving tube 40, but it has a problem in which coins may be fallen down into a wrong-sized coin receiving tube 40 near the coin receiving tube 40 which the coins are intended to be fallen into, while the coins are received in the coin receiving tube 40 after the first coin receiving tube 40 is filled up with coins.

In addition, when taking out one coin receiving tube 40, which is filled up with coins, the overall operation of the coin sorting apparatus should be stopped.

SUMMARY OF THE INVENTION

The present invention is provided to solve the aforementioned problems.

An object of the present invention is to provide a coin sorting apparatus to solve the problem in which the coins discharged through a guide are received in a wrong coin receiving tube which has a different size than the size of the coins.

Another object of the present invention is to provide a coin sorting apparatus for allowing to take out only the coin receiving tube, which is filled up with coins, even with the sorting process going on.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a coin sorting apparatus include: a coin sorting means for separating and sorting coins according to the respective sizes of coins; a guide for directing the sorted coins separated according to the size in the coin sorting means to a predetermine location; a coin receiving tube located at an end portion of the guide, and sloped at an angle of 30° or less from the guide; a tube receiving container which at least one coin receiving tube for the same size of coins is equipped in, and has a hand holder on one end of the tube receiving container for easy push-in or pulling-out of the tube receiving container, and a sliding protrusion on a lower side of the tube receiving container for slidably moving the tube receiving container back and forth within a predetermined distance; and a sliding member located under the tube receiving container, and having a sliding groove coupled with the sliding protrusion, for slidably moving the tube receiving container back and forth.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 7:
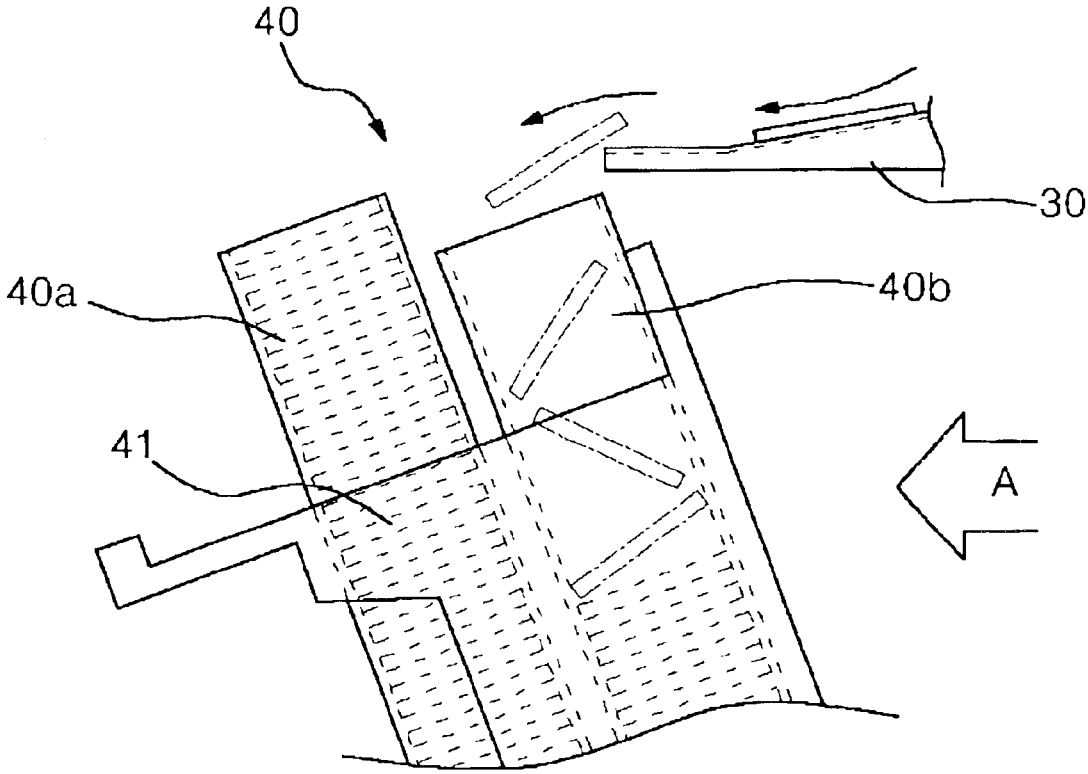
FIG. 7 is a schematic view for illustrating a principle that coins are received in a coin sorting apparatus of the present invention.

FIG. 7 is a schematic view for illustrating a principle that coins are received into a coin receiving tube in a coin sorting apparatus of the present invention.

Referring to FIG. 7, in the coin sorting apparatus of the present invention, coins are received by the following steps. First, coins, which are sorted according to the size thereof, are moved along a guide 30, and then, are received in a first coin receiving tube 40*a* adjacent to the guide 30. If the first coin receiving tube 40*a* is filled with a predetermined amount of coins, the first coin receiving tube 40*a* is moved toward a predetermined direction A, and finally, another coin receiving tube 40*b* is moved and takes the place of the first coin receiving tube 40*a*.

In more detail, the coin sorting apparatus of the present invention can be constituted to have at least two coin receiving tubes for the same size of coins, and the movement direction of the first coin receiving tube 40*a* can be arbitrarily determined.

With regard to the coin receiving tubes 40*a*, 40*b*, the coin receiving tube 40 is preferably placed with a slope having an angle difference of 30° or less relative to the slope of the guide 30, or it is more preferable to place the coin receiving tube with a slope that is the same as the slope of the guide 30 such that sorted coins, which are moved along the guide 30, are easily put into the coin receiving tube 40.

In addition, the coin receiving tube 40, which is equipped in a tube receiving container, is preferably adapted to move along with the tube receiving container. The movement of the tube receiving container can be exerted manually by a user, or automatically sensing the weight of the coins stacked inside the coin receiving tube 40.

The movement of the tube receiving container can be realized by mechanical and electronic methods.

As described above, sorted coins, which move along the guide 30, are received in the first coin receiving tube 40*a* adjacent to the guide 30, and if the first coin receiving tube 40*a* is filled with a predetermined amount of coins, the first coin receiving tube 40*a* is moved toward a predetermined direction, and finally, another coin receiving tube 40*b*, which is placed adjacent to the first coin receiving tube 40*a*, is moved and takes the place of the first coin receiving tube 40*a*.

The above receipt method of coins solves the disadvantage of the conventional coin sorting apparatus using a free falling method, that is, if the coin receiving tube 40*a* adjacent to the guide 30 is filled up with sorted coins, the overflowing coins go into another coin receiving tube 40*b* adjacent to the coin receiving tube 40*a*, which causes a problem in that the overflowing coins go into a third coin receiving tube for the different size of coins, or fallen down to the ground.

Figure 8:
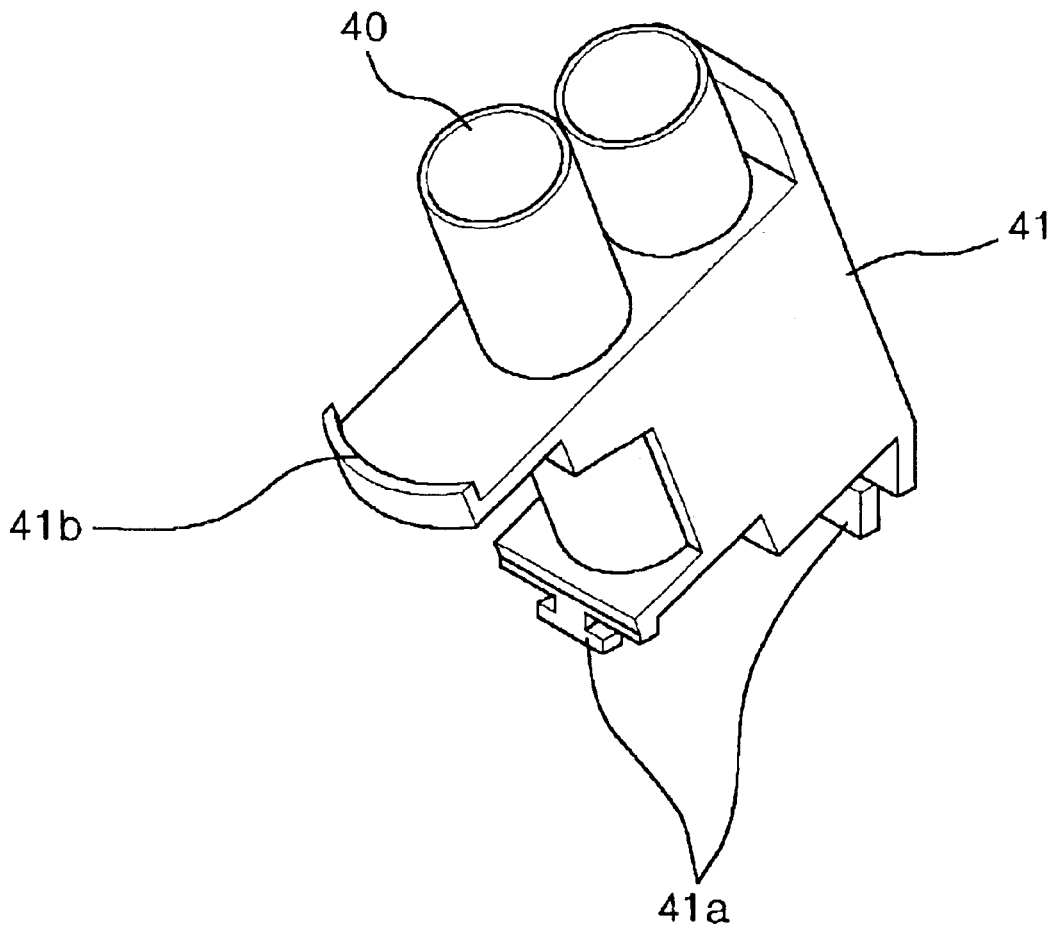
FIG. 8 is a perspective view of the tube receiving container having the coin receiving tubes mounted thereon in the coin sorting apparatus of the present invention.

FIG. 8 is a perspective view of the tube receiving container provided with the coin receiving tubes in a coin sorting apparatus of the present invention.

Referring to FIG. 8, at least one coin receiving tube 40 is equipped in the tube receiving container 41, and the coin receiving tube 40 is preferably placed with a slope having an angle difference of 30° or less relative to the slope of the guide 30 which sorted coins are moved along, and each of the coin receiving tubes 40 is preferably figured to have a predetermined height such that each of the coin receiving tubes 40 may not be caught into the guide 30 when the tube receiving container 41 is moved.

On the bottom of the tube receiving container 41, there is provided a sliding protrusion 41*a* such that the tube receiving container 41 is easily moved down a predetermined distance. On a portion of the tube receiving container 41, there is provided a hand holder 41*b* such that a user can hold the tube receiving container 41 by the hand holder 41*b* to easily push in and pull out the tube receiving container 41.

The tube receiving container 41 is made to match with the respective size of coins, and the same size of the coin receiving tubes 40 are equipped in the same tube receiving containers 41.

Figure 9:
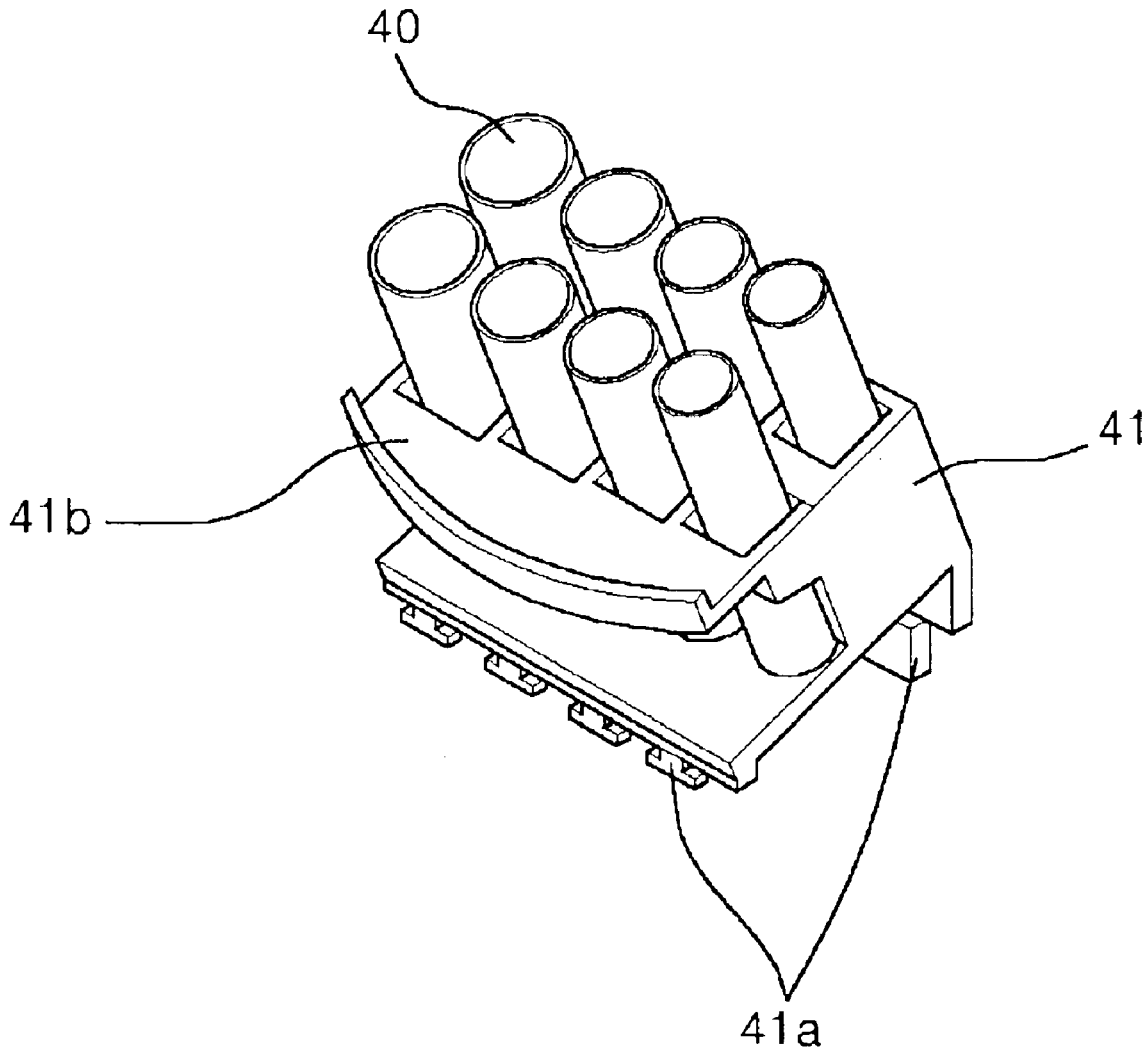
FIG. 9 is a perspective view of a tube receiving container having coin receiving tubes mounted thereon in a coin sorting apparatus according to another embodiment of the present invention.

FIG. 9 is a perspective view of a tube receiving container having coin receiving tubes equipped therein in a coin sorting apparatus according to another embodiment of the present invention.

Referring to FIG. 9, the coin sorting apparatus according to another embodiment of the present invention as shown in the FIG. 9 has almost the same structure as that of FIG. 8 just except that all of the tube receiving containers 41 shown in FIG. 8, which the coin receiving tubes 40 are equipped in, are formed in an integral type such that the coin receiving tubes 40 having different sizes are all equipped in one tube receiving container 41.

Since the tube receiving containers 41 are formed in an integral type, the production costs are reduced and the manufacturing process is simplified.

Figure 10:
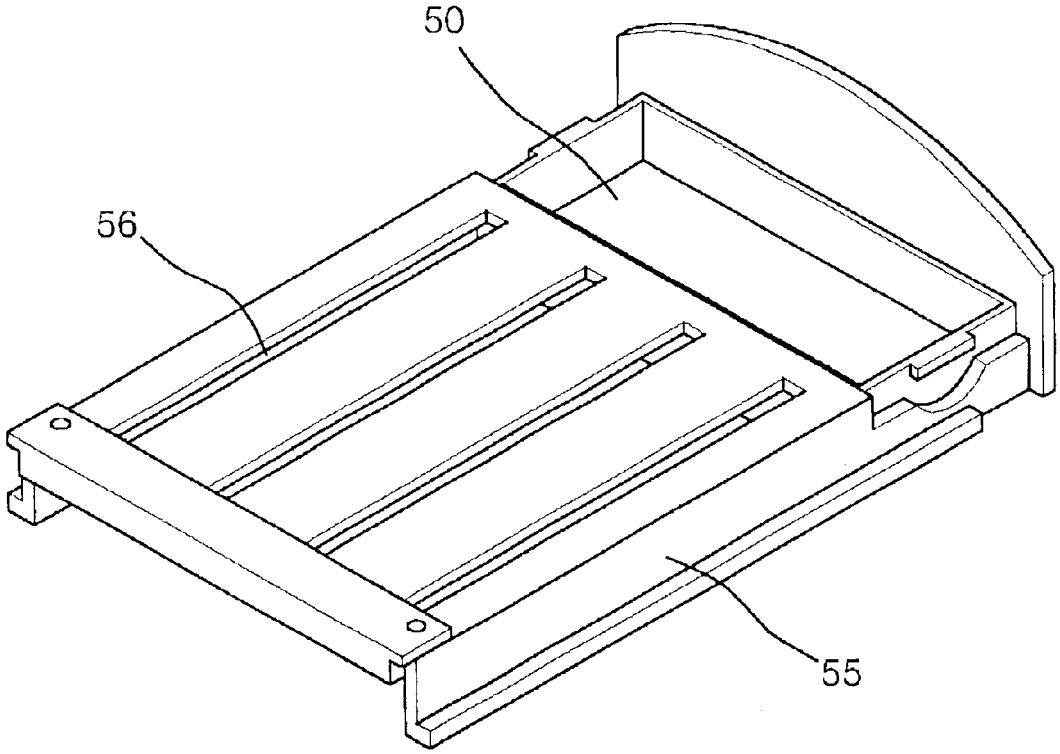
FIG. 10 is a perspective view of a sliding member being coupled with the tube receiving container in the coin sorting apparatus of the present invention.

FIG. 10 is a perspective view of a sliding member being coupled with the tube receiving container in the coin sorting apparatus of the present invention.

Referring to FIG. 10, the tube receiving container 41 is installed on a sliding member 55. The sliding member 55 is provided with a sliding groove 56 to allow the tube receiving container 41 to move back and forth.

The number of the sliding grooves 56 is the same as that of the tube receiving containers 41.

However, in the case of the integral-type tube receiving container 41, two sliding grooves can be formed on the both ends of the sliding member 55 just corresponding to the two coin receiving tubes 40 placed on the side ends of the tube receiving container 41. Or, more than two sliding grooves can be provided.

In addition, a fallen-coin drawer 50 is arranged at one side of the sliding member 55, for receiving coins which are not put into the coin receiving tube, or are overflowing from the coin receiving tube.

Figure 11:
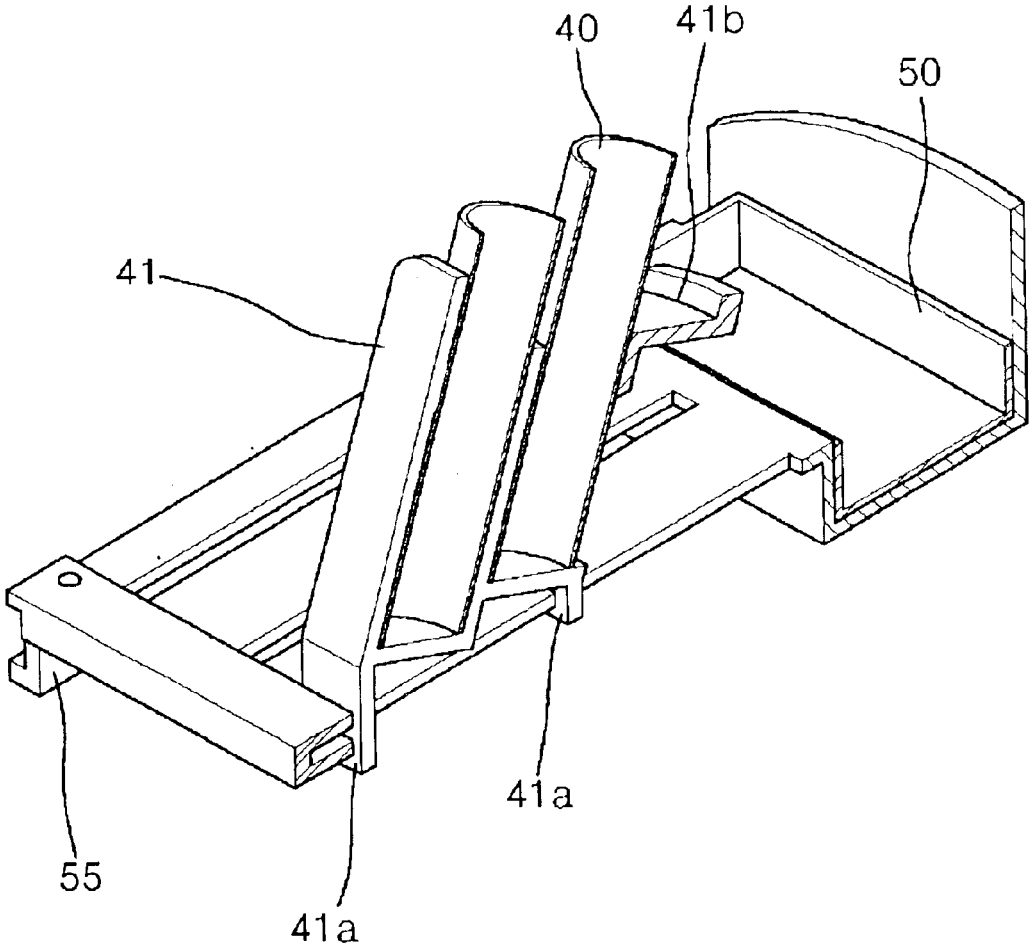
FIG. 11 is a view partially showing that the tube receiving container is coupled with the sliding member in the coin sorting apparatus of the present invention.

FIG. 11 is a view partially showing that the tube receiving container is coupled with the sliding member in the coin sorting apparatus of the present invention.

As shown in FIG. 11, the sliding protrusion 41*a* is coupled with the sliding groove 56 formed on the sliding member 55 so that the tube receiving container 41 moves back and forth along the sliding groove 56.

In addition, the coin receiving tubes 40 equipped in the tube receiving container 41 are preferably sloped with a predetermined angle and all of the coin receiving tubes 40 are preferably figured to have the same height.

Figure 12:
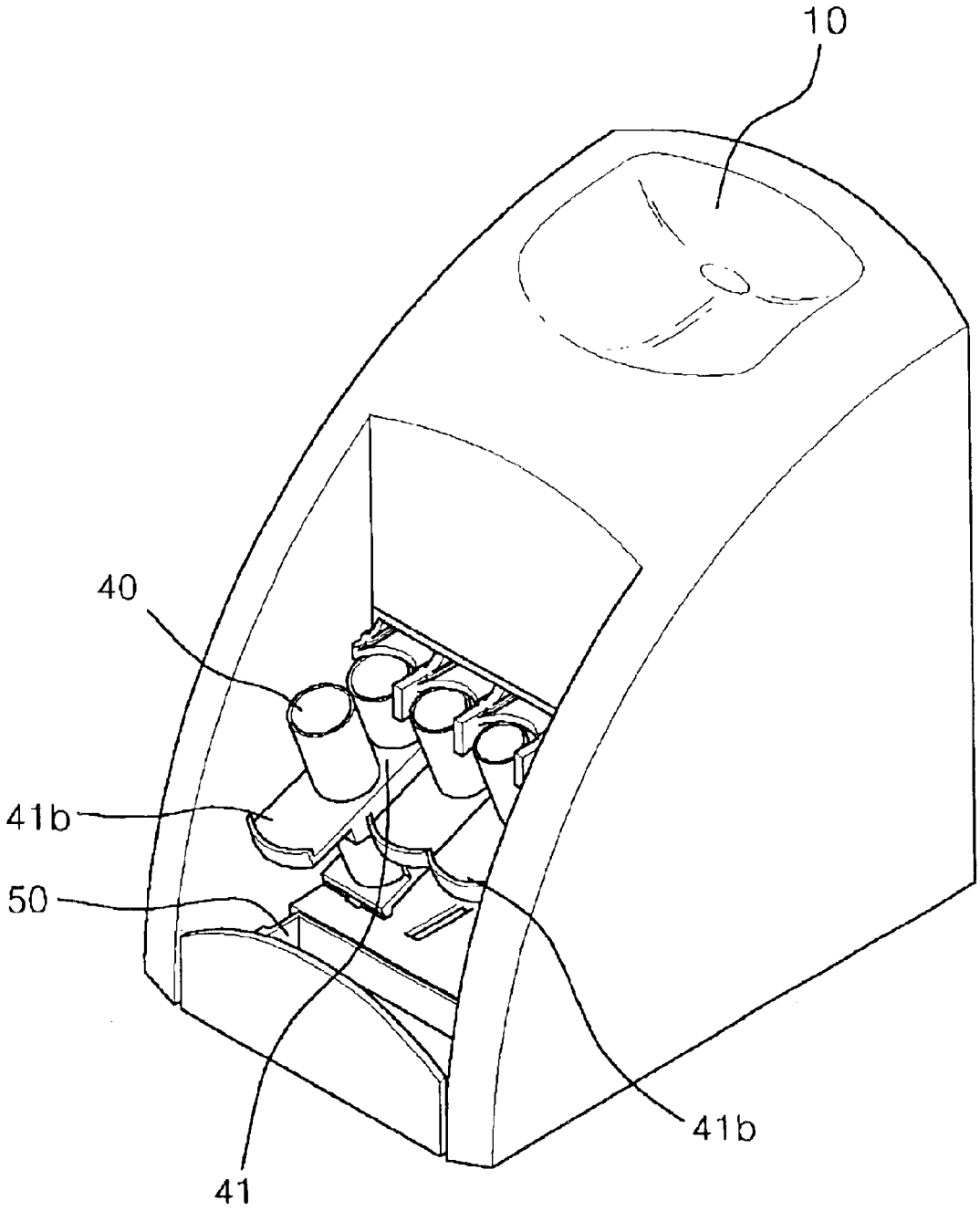
FIG. 12 is a perspective view of the coin sorting apparatus of the present invention from the outer look.

FIG. 12 is a perspective view of the coin sorting apparatus of the present invention from the outer look.

As shown in FIG. 12, unsorted coins, which are supplied in a coin slot 10, are separated and sorted according to respective size and discharged through the guide 30.

When one of the coin receiving tubes 40 is filled with coins, and if a user pulls the hand holder 41*b*, another coin receiving tube 40 located under the guide 30 takes place of the first coin receiving tube 40 filled with coins, and a user can take the coin receiving tube 40 filled with coins out of the tube receiving container 41.

Figure 1:
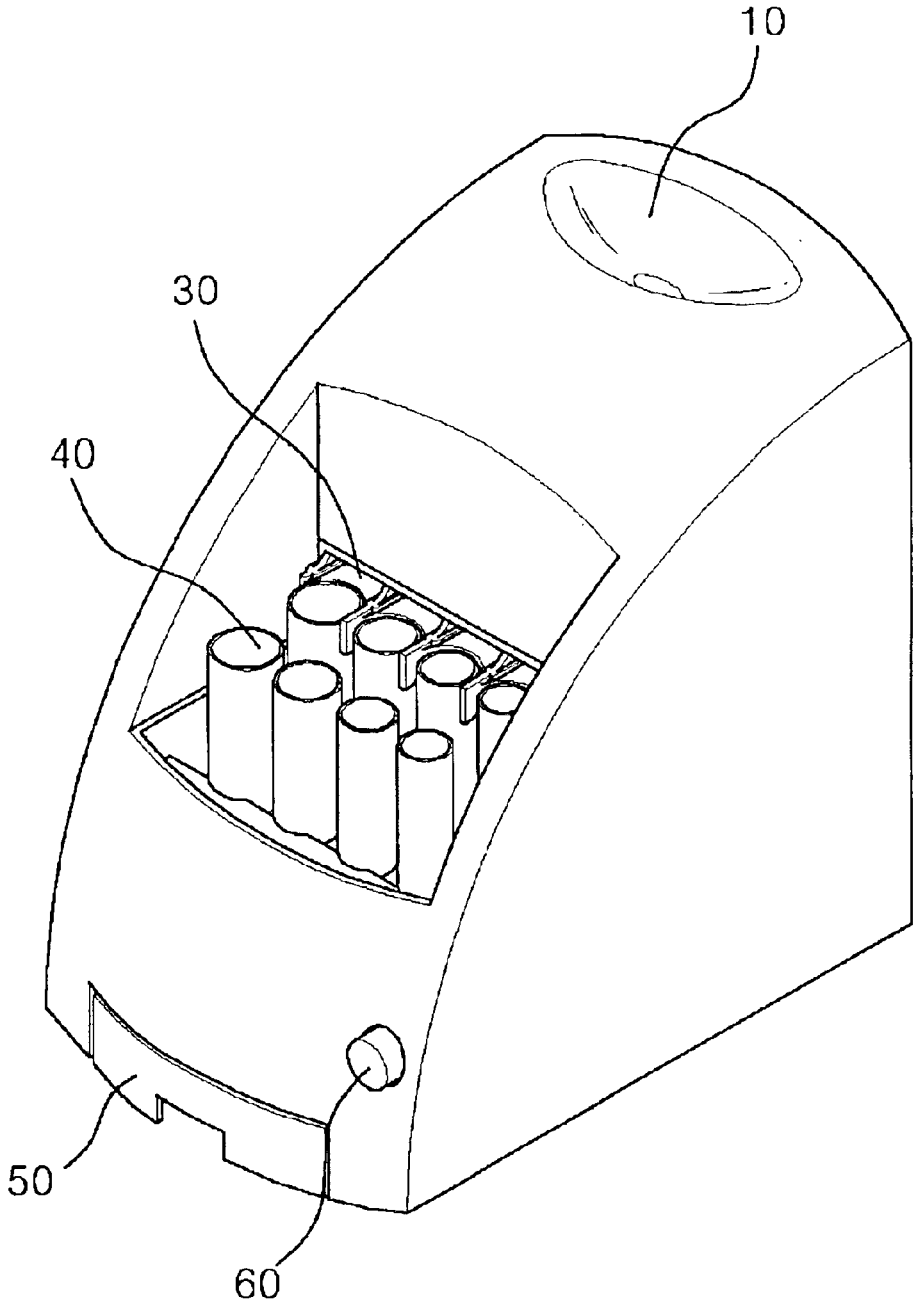
FIG. 1 (Related Art)
FIG. 1 is a perspective view of a conventional typical coin sorting apparatus from the outer look.
Figure 2:
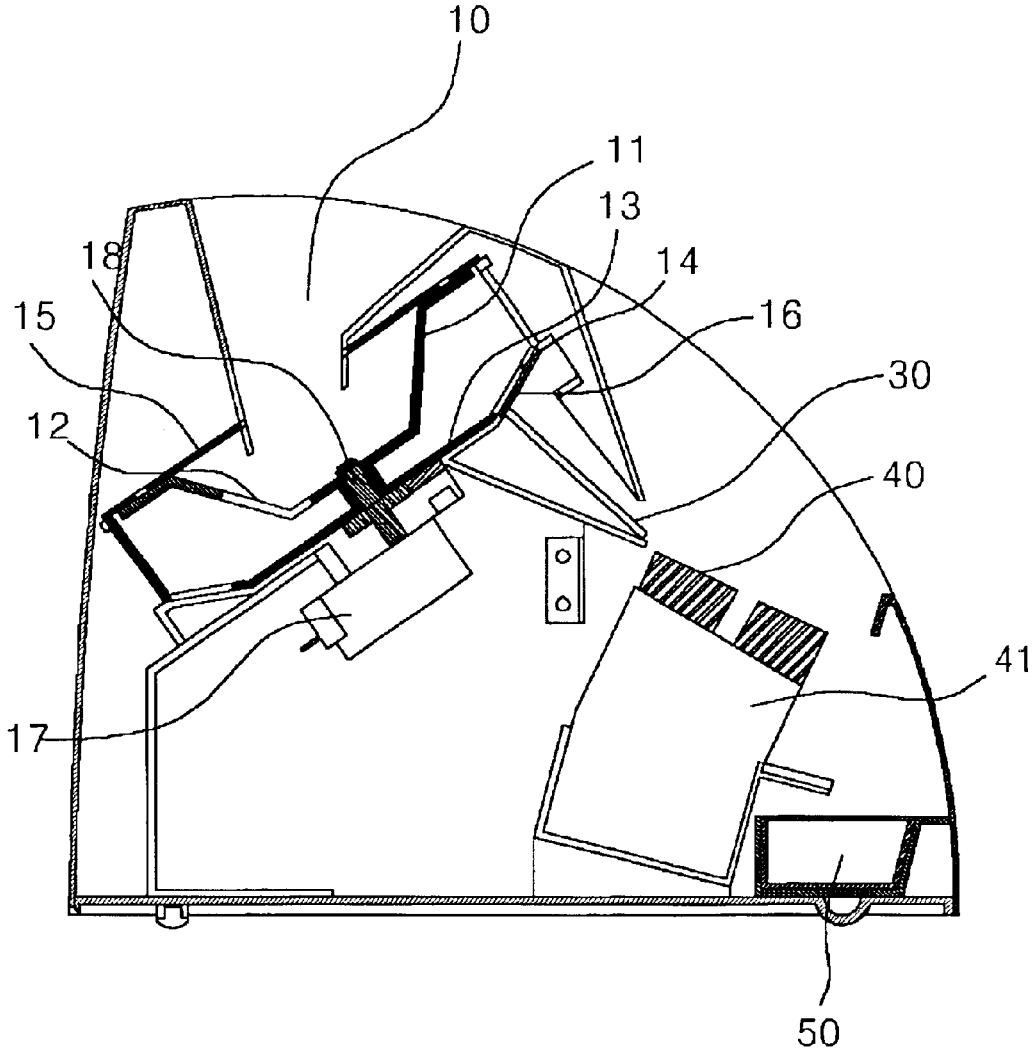
FIG. 2 (Related Art)
FIG. 2 is a sectional view of a conventional typical coin sorting apparatus.
Figure 3:
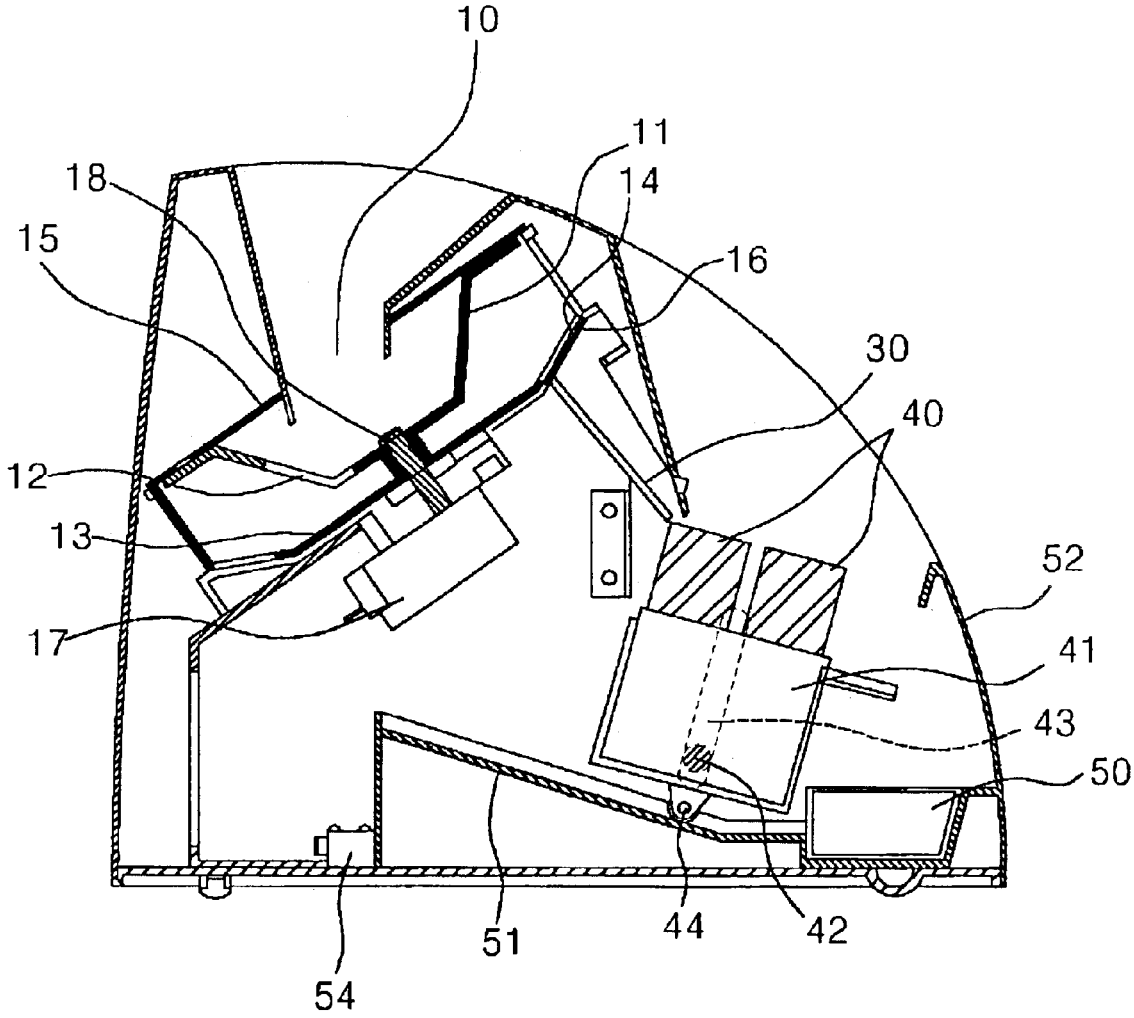
FIG. 3 (Related Art)
FIG. 3 is a sectional view of a conventional typical coin sorting apparatus with a sliding unit installed under coin receiving tubes.
Figure 4:
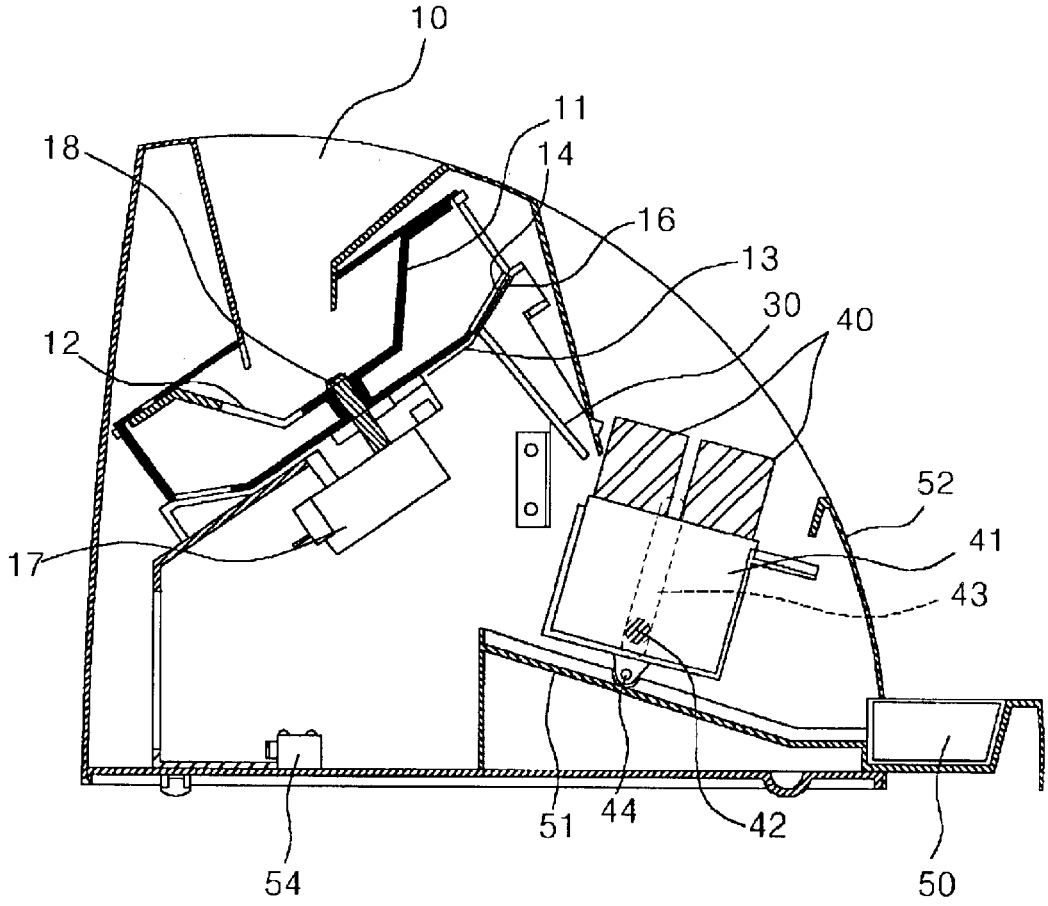
FIG. 4 (Related Art)
FIG. 4 is a sectional view of the conventional coin sorting apparatus with the sliding unit installed under coin receiving tubes and the fallen-coin drawer pulled out.
Figure 5:
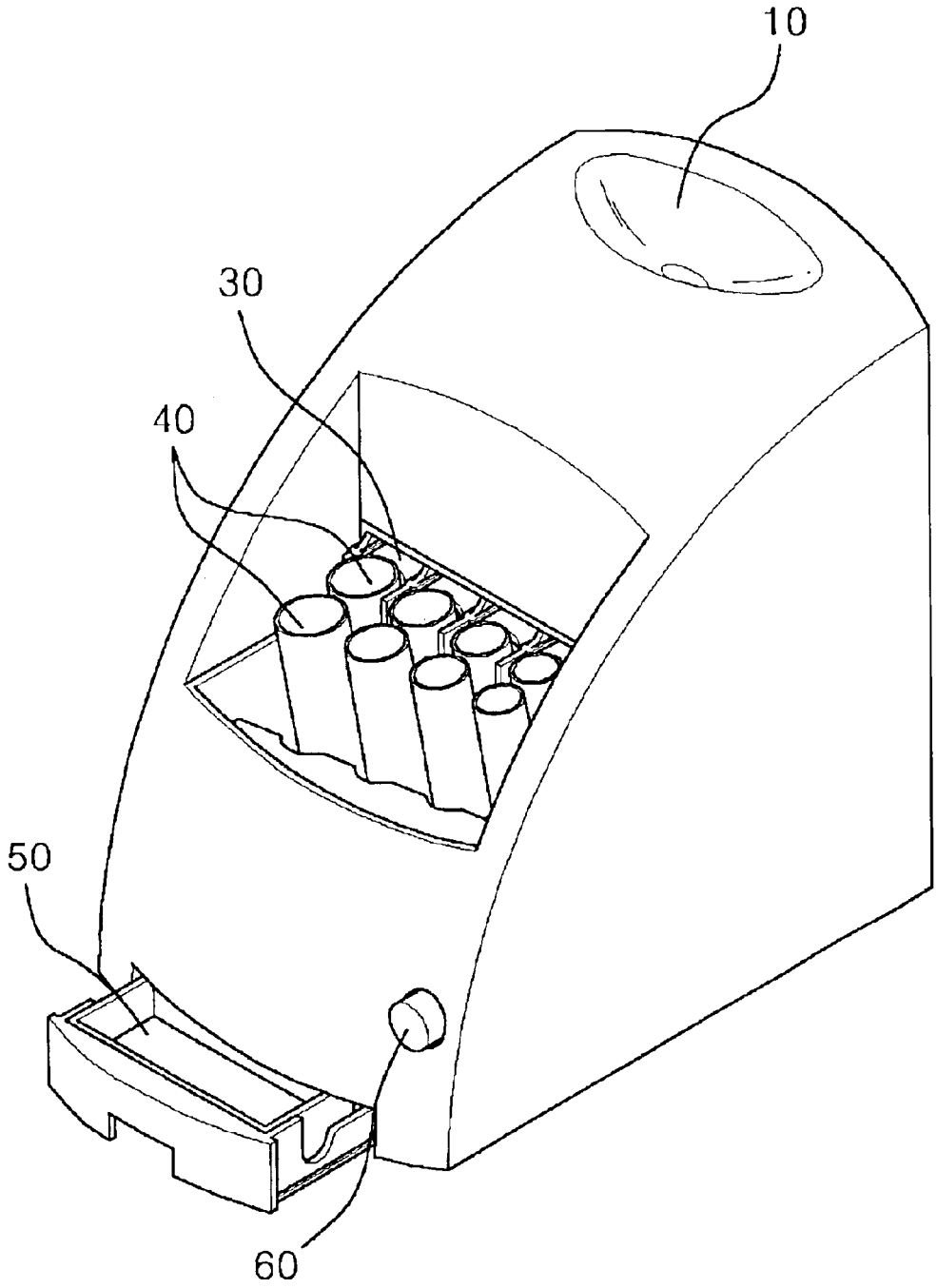
FIG. 5 (Related Art)
FIG. 5 is a perspective view of the conventional coin sorting apparatus for illustrating a status in which the fallen-coin drawer is pulled out, a power turned off, and the tube receiving container is raised up by a slope member.
Figure 6:
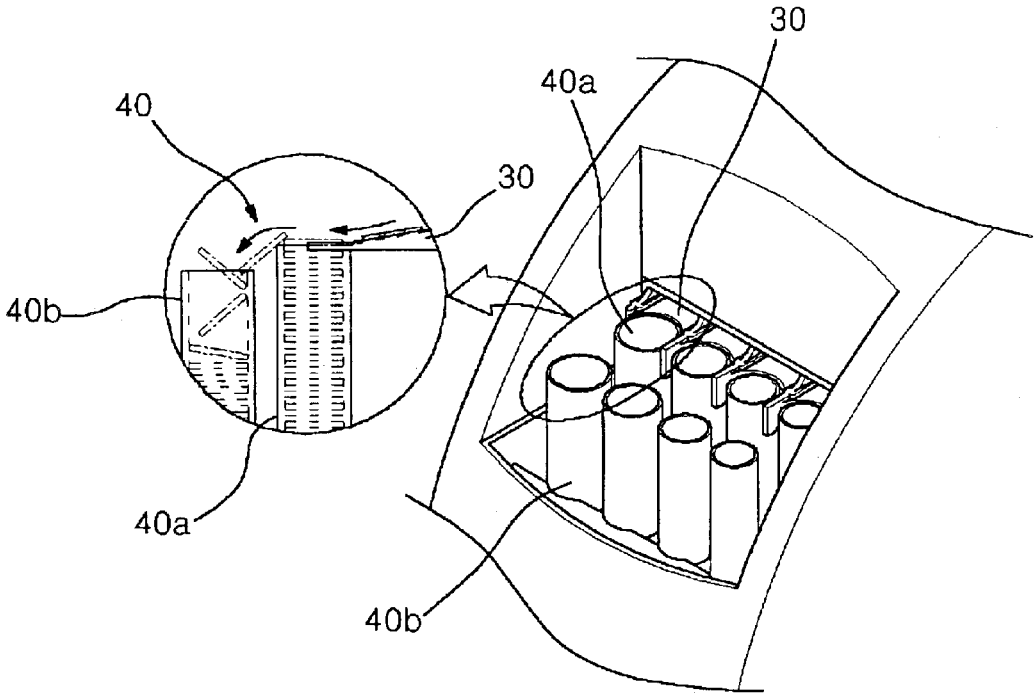
FIG. 6 (Related Art)
FIG. 6 is a schematic view for illustrating a principle that coins are received into the coin receiving tube in the conventional coin sorting apparatus.

Therefore, according to the present invention, it has an advantage in that the coin receiving tube 40 filled with coins can be taken out of the tube receiving container 41 while the coins are being separated and sorted thereby to solve the problem of the method of sorting coins by the conventional coin sorting apparatus described in FIG. 6.

However, in the case of the integral-type tube receiving container 41 illustrated in FIG. 9, if pulling the hand holder 41*b*, all of the coin receiving tubes 40 adjacent to the guide 30 are taken out.

Therefore, even though the coin receiving tubes 40, which are not filled up with coins, are also taken out, the coin receiving tubes 40 can be taken out while the coins are sorted.

Figure 13:
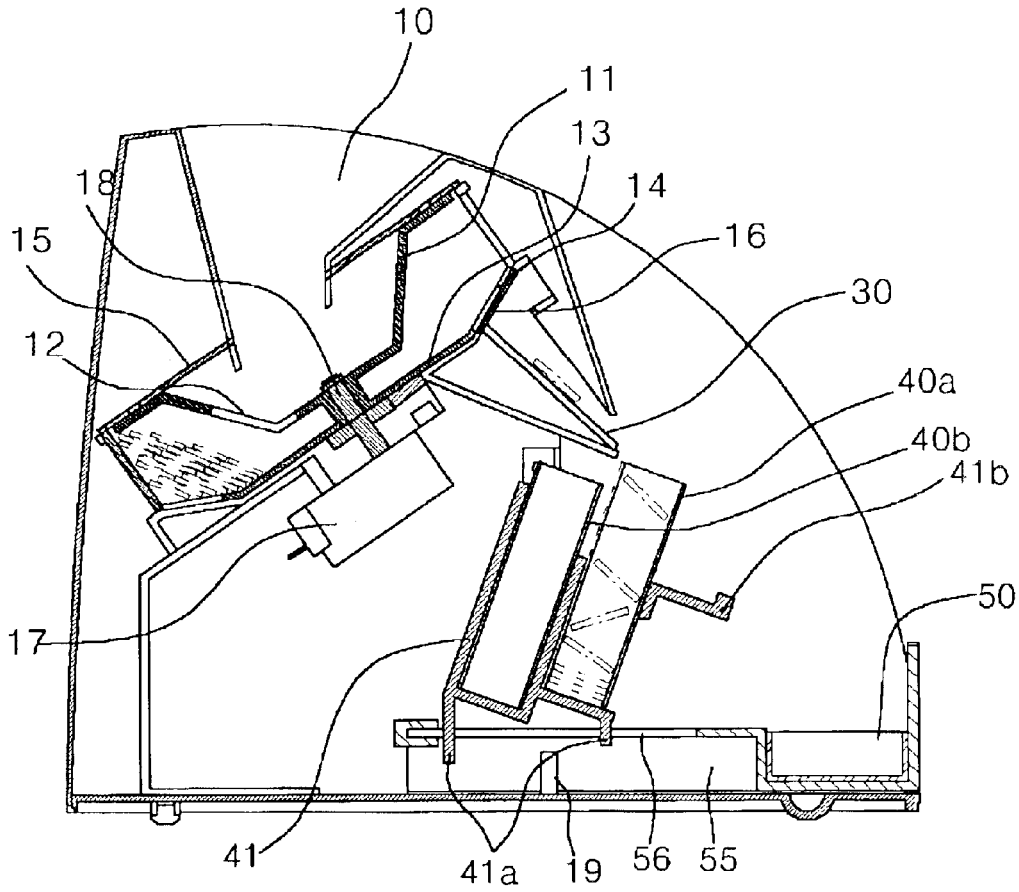
FIG. 13 is a sectional view of the coin sorting apparatus of the present invention to illustrate the operation of a coin receiving device.

FIG. 13 is a sectional view of the coin sorting apparatus of the present invention illustrating the operation of a coin receiving device.

First, the coin sorting apparatus includes a coin slot 10 for receiving coins deposited by a user, a supply control container 11 for allowing a large amount of coins received by the coin slot 10 to be put into a coin sorting assembly by a small amount, a supply hole 12 being formed on the side wall of the supply control container 11, for allowing coins to be put therethrough by the small amount, a cover 15 for covering the coins inside the supply control container 11 when the supply control container 11 is rotated in order to prevent the coins from coming out of the supply control container 11, a carrier container 13 for carrying the coins supplied through the supply hole 12 so that the coins are sorted by a carrier hole 14 and a separation hole 16, a rotation shaft 18 and a motor 17 for rotating the supply control container 11 and the carrier container 13.

In addition, the coin sorting apparatus further includes the guide 30 for guiding the receipt of the sorted coins from the separation hole 16, the coin receiving tubes 40*a*, 40*b* for receiving the coins, which are sorted according to the size and discharged through the guide 30, the tube receiving container 41 on which the coin receiving tubes 40*a*, 40*b* are mounted, the sliding member 55 located under the tube receiving container 41 and coupled with the tube receiving container 41 to slidably move the tube receiving container 41 back and forth, a protrusion 19 located on the lower side of the sliding member 55 so that the sliding member 55 and the tube receiving container 41 are not withdrawn further a predetermined distance, and the fallen-coin drawer 50 for collecting the fallen coins, which are not received in the coin receiving tube 40.

The coin receiving tubes 40*a*, 40*b* are preferably placed with a slope having an angle difference of 30° or less relative to the slope of the guide 30.

In the case that the slope angle between the guide 30 and the coin receiving tube 40 is greater than 30°, coins are not received appropriately, and get out of the desired path.

The coin receiving tubes 40*a*, 40*b* are the tubes for receiving the same size of coins, and they have the same size, and are placed along the direction in which coins are fallen down from the guide 30.

Even though just two coin receiving tubes 40*a*, 40*b* are illustrated in the drawing, one, two, or more than two coin receiving tubes can be provided.

In addition, there is preferably provided the hand holder 41*b* on one side wall of the tube receiving container 41 to easily pull the tube receiving container 41.

In addition, the sliding grooves 56 are provided on the sliding member 55 in the moving direction of the tube receiving container 41, for helping to easily push in and pull out the tube receiving container 41, and the sliding protrusion 41*a* is provided on the lower surface of the tube receiving container 41 to be coupled with the sliding grooves 56.

In addition, the protrusion 19 is preferably provided on the lower side of the sliding member 55 so that the sliding member 55 and the tube receiving container 41 are not withdrawn further a predetermined distance.

Now hereinafter, the operation of the coin sorting apparatus of the present invention structured as above is described. If a large amount of coins are supplied into the coin slot 10, the coins are received in the supply control container 11. Then, a small amount of coins are put into the carrier container 13 through the supply hole 12 formed on the side wall of the supply control container 11 when the supply control container 11 is rotated.

The coins, which are put into the carrier container 13, are inserted into the carrier hole 14 formed on the carrier container 13 while the carrier container 13 is rotated, and then, the coins are moved into the separation hole 16 with the carrier container 13 rotated.

The separation hole 16 can be provided with a plurality of holes having different size, and the separation holes 16 are provided in an order from the big size to the small size according to the rotation direction of the carrier hole 14.

Therefore, small size of coins are discharged through the separation hole 16, and then, the biggest size of coins are finally discharged through the separation hole 16.

The rotation of the supply control container 11 and the carrier container 13 are driven by the rotation shaft 18 and the motor 17 placed under the carrier container 13.

The sorted coins passing through the separation hole 16 are moved along the guide 30, and received in the coin receiving tube 40.

The coin receiving tube 40 can be provided by one according to the respective size of coins, or as shown in the drawings, there are provided two coin receiving tubes 40 having the same size for the same size of coins.

After the sorting of coins are completed, a user can take out the coin receiving tube 40 which contains a desired kind of coins.

Figure 14:
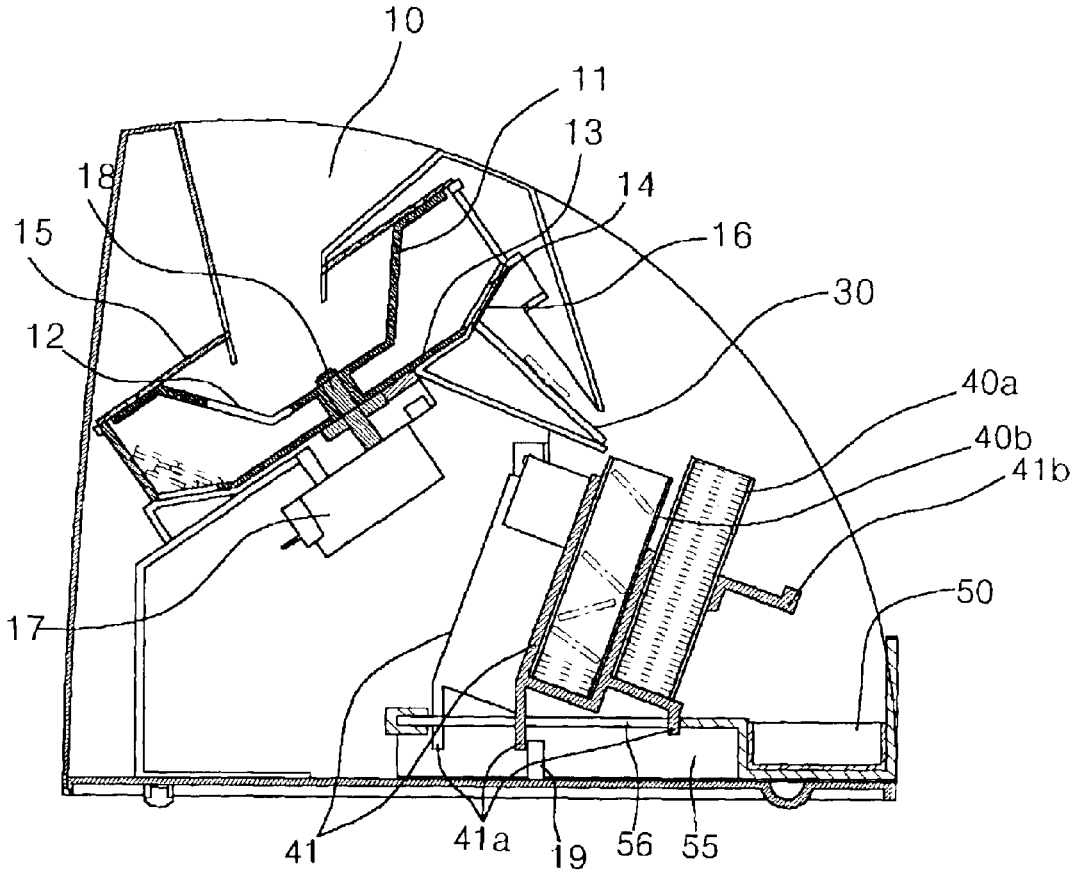
FIG. 14 is a sectional view of the coin sorting apparatus of the present invention to illustrate the moving state of the tube receiving container.

FIG. 14 illustrates the state that the tube receiving container is moved and withdrawn in the coin sorting apparatus of the present invention.

After supplied coins are sorted, they fill the coin receiving tubes 40*a* adjacent to the guide 30, and when the coin receiving tubes 40*a* is filled up with coins, and if a user pulls the hand holder 41*b*, the tube receiving container 41 is moved, and another coin receiving tube 40*b*, which is located under the guide 30 and not filled up with coins, takes place of the first coin receiving tube 40*a* and is placed adjacent to the guide 30.

The coin receiving tubes 40*a*, 40*b* for receiving the same size of coins are equipped in one tube receiving container 41, and the coin receiving tubes 40*a*, 40*b* for receiving different size of coins are equipped in different tube receiving containers 41 respectively according to the respective size of coins to be sorted. FIG. 14 illustrates that one tube receiving container 41 having the same size of coin receiving tubes 40*a*, 40*b* is withdrawn.

When one of the coin receiving tubes 40*a* is filled up with coins, only the tube receiving container 41 having the coin receiving tube 40*a* mounted thereon is withdrawn, and the coin receiving tube 40*a* can be removed from the tube receiving container 41.

Here, another coin receiving tube 40*b*, which is not filled up with coins, is placed adjacent to the guide 30, and coins carried from the guide 30 are received in the coin receiving tube 40*b* continuously.

The coin receiving tube 40 and the tube receiving container 41 for different size of coins from the above case also receive the coins as illustrated in FIG. 13.

However, in the case of the integral-type tube receiving container 41 illustrated in FIG. 9, if pulling the hand holder 41*b*, all of the coin receiving tubes 40 adjacent to the guide 30 are taken out, and the coin receiving tubes 40 placed under the guide 30 are placed adjacent to the guide 30 so that the receipt of the sorted coins can be continuous.

When pulling out the tube receiving container 41 having the coin receiving tube 40*a* filled up with coins mounted thereon, the tube receiving container 41 is not withdrawn further a predetermined distance by controlling the length of the sliding groove 56 provided on the sliding member 56 so that the coin receiving tube 40*b*, which is not filled up with coins, is placed adjacent to the guide 30 to receive coins.

Figure 15:
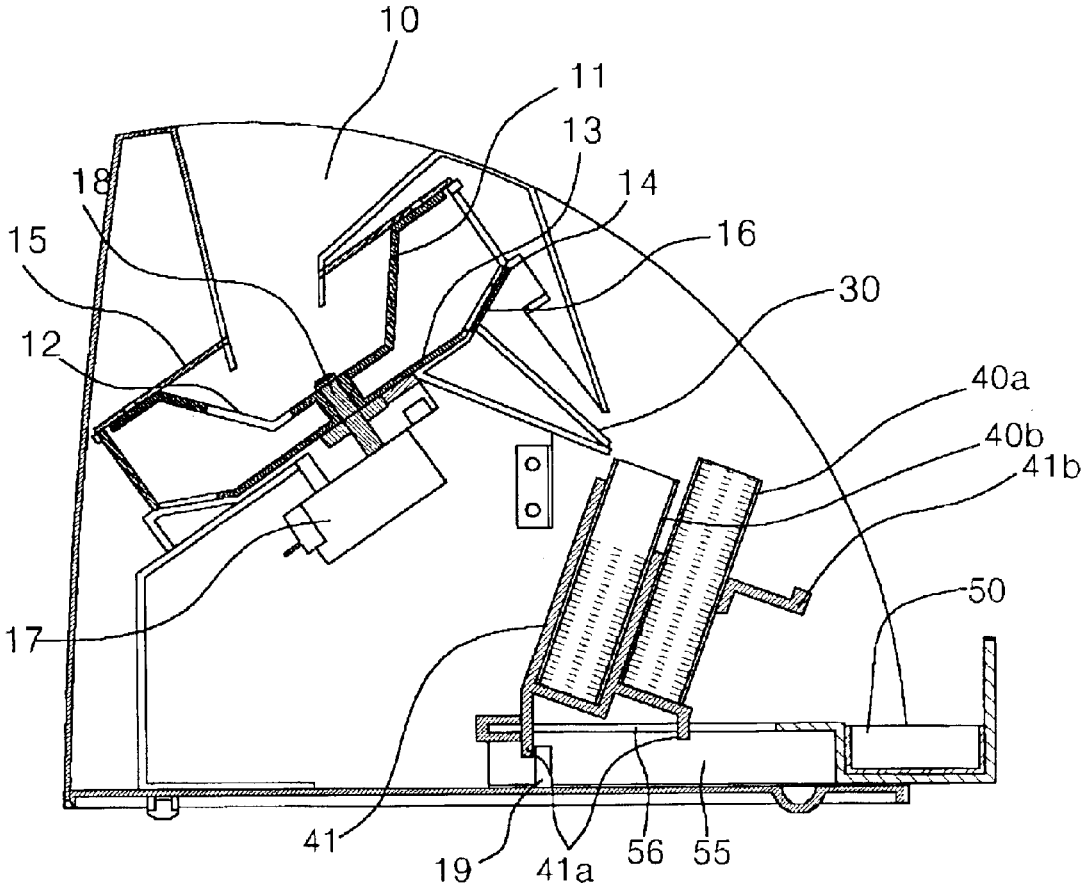
FIG. 15 is a sectional view of the coin sorting apparatus of the present invention to illustrate that the sliding member is withdrawn and the fallen-coin drawer is pulled out after the coin sorting process is completed.

FIG. 15 is a sectional view of the coin sorting apparatus of the present invention to illustrate that the sliding member is withdrawn after the coin sorting process is completed.

Referring to FIG. 15, after the sorting of coins is completed, and if pulling the sliding member 55 having the fallen-coin drawer 50, all of the tube receiving containers 41 having the coin receiving tubes 40*a*, 40*b* mounted thereon can be pulled out.

In other words, the tube receiving containers 41 can be pulled out individually as described above, or all of the tube receiving containers 41 can be pulled out at one time by pulling the sliding member 55.

However, in the case of the integral-type tube receiving container 41 illustrated in FIG. 9, pulling out of all of the tube receiving containers 41 only is possible.

The protrusion 19 is provided on the lower side of the sliding member 55 so that the tube receiving container 41 and the sliding member 55 are not withdrawn further a predetermined distance when pulling the sliding member 55.

When pulling the sliding member 55 as above, a user can remove the coin receiving tube 40*b*, which is not filled up with coins, from the tube receiving container 41 as well as the coin receiving tube 40*a*, which is filled up with coins.

Therefore, the coin sorting apparatus of the present invention provides an advantage of solving the problem of the conventional coin sorting apparatus in which different size of coins are often received in one coin receiving tube since the coin sorting apparatus of the present invention uses the method of receiving coins carried along the guide in one coin receiving tube while the tube receiving container having the coin receiving tubes moves back and forth.

In addition, the coin sorting apparatus of the present invention provides an advantage in that the coin receiving tube filled up with coins can be taken out individually from the other coin receiving tubes while the sorting of coins is in process, and the receipt of coins is continuously possible.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A coin sorting apparatus comprising:

a coin sorting means for separating and sorting coins according to the respective sizes of coins;

a guide for directing the sorted coins separated according to the size in the coin sorting means to a predetermine location;

a coin receiving tube located at an end portion of the guide, and sloped at an angle of 30° or less from the guide;

a tube receiving container which at least one coin receiving tube for the same size of coins is equipped in, and has a hand holder on one end of the tube receiving container for easy push-in or pulling-out of the tube receiving container, and a sliding protrusion on a lower side of the tube receiving container for slidably moving the tube receiving container back and forth within a predetermined distance; and a sliding member located under the tube receiving container, and having a sliding groove coupled with the sliding protrusion, for slidably moving the tube receiving container back and forth.

2. The coin sorting apparatus of claim 1, wherein the coin sorting means comprises: a motor; a rotation shaft for transferring a rotation force generated from the motor; a carrier container coupled with the rotation shaft, and having a carrier hole on a side of the carrier container so that the coin is stacked in ones inside the carrier hole; and a separation hole formed with a plurality of holes that are different in size such that the coins are sorted according to the respective size of the coins when the separation hole is in communication with the carrier hole of the carrier container.

3. A coin sorting apparatus comprising:

a coin sorting means for separating and sorting coins according to a respective size of coins;

a guide for directing the sorted coins separated according to the size in the coin sorting means to a predetermined location;

a coin receiving tube located at an end portion of the guide for receiving the coins;

a tube receiving container in which the at least one coin receiving tube for receiving the same size of coins is equipped, the tube receiving container having a sliding protrusion formed on a lower side thereof; and a sliding member located under the tube receiving container and coupled with the tube receiving container for slidably moving the tube receiving container back and forth.

4. The coin sorting apparatus of claim 3, wherein the coin sorting means comprises: a motor; a rotation shaft for transferring a rotation force generated from the motor; a carrier container coupled with the rotation shaft, and having a carrier hole on a side of the carrier container so that the coin is stacked in ones inside the carrier hole; and a separation hole formed with a plurality of holes that are different in size such that the coins are sorted according to the respective size of the coins when the separation hole is in communication with the carrier hole of the carrier container.

5. The coin sorting apparatus of claim 3, wherein the coin receiving tube is formed with a slope having an angle difference of 30° or less relative to the slope of the guide.

6. The coin sorting apparatus of claim 3, wherein the tube receiving container is provided at one side thereof with a hand holder for easily pulling out the tube receiving container.

7. The coin sorting apparatus of claim 3, wherein the sliding member comprises a sliding groove formed along a pulling-out direction of the tube receiving container such that the tube receiving container is easily moved, and is not pushed in or pulled out above a predetermined distance.

8. The coin sorting apparatus of claim 3, further comprising a fallen-coin drawer provided on one side of the sliding member, for receiving the coins, which are not received in the coin receiving tube.

9. The coin sorting apparatus of claim 3, wherein the sliding member is provided at a lower side thereof with a protrusion such that the tube receiving container and the sliding member are not pulled out across a predetermined distance.

10. The coin sorting apparatus of claim 3, wherein the plurality of the tube receiving containers are formed in an integral type such that the plurality of the coin receiving tubes being different in size are all equipped in the integral type tube receiving container.

11. A coin receiving device of a coin sorting apparatus, the coin receiving device comprising:

a guide for directing coins sorted according to a size thereof to a predetermined location;

a coin receiving tube located adjacent to an end portion of the guide for receiving coins;

a tube receiving container in which at least one coin receiving tube having the same size as the coins is equipped in, where the tube receiving container includes a sliding protrusion formed on a lower side thereof; and a sliding member located under the tube receiving container and coupled with the tube receiving container for slidably moving the tube receiving container back and forth.

12. The coin receiving device of claim 11, wherein the coin receiving tube is formed with a slope having an angle difference of 30° or less relative to the slope of the guide.

13. The coin receiving device of claim 11, wherein the tube receiving container is provided at one end thereof with a hand holder for easily pulling out the tube receiving container.

14. The coin receiving device of claim 11, wherein the sliding member comprises a sliding groove formed along a pulling-out direction of the tube receiving container such that the tube receiving container is easily moved, and is not pushed in or pulled out above a predetermined distance.

15. The coin receiving device of claim 11, further comprising a fallen-coin drawer provided on one side of the sliding member, for receiving the coins, which are not received in the coin receiving tube.

16. The coin receiving device of claim 11, wherein the sliding member is provided at a lower side thereof with a protrusion such that the tube receiving container and the sliding member are not pulled out across a predetermined distance.

17. The coin receiving device of claim 11, wherein the plurality of the tube receiving containers are formed in an integral type such that the plurality of the coin receiving tubes being different in size are all equipped in the integral type tube receiving container.

18. A method of receiving coins in a coin sorting apparatus comprising the steps of:

a) moving coins sorted according to size to a predetermined location along a guide;

b) filling a coin receiving tube located adjacent to the lower end of the guide with the sorted coins; and c) moving a tube receiving container, which the coin receiving tube is equipped in, in a predetermined direction if the coin receiving tube is filled up with a predetermined amount of coins, and placing another coin receiving tube, which is equipped in the tube receiving container and adapted to receive the same size of coins, adjacent to the lower end of the guide.

19. The method of claim 18, wherein the coin receiving tube is formed with a slope having an angle difference of 30° or less relative to the slope of the guide.

20. A coin sorting apparatus comprising:

a coin sorting means for separating and sorting coins according to the respective sizes of coins;

a guide for directing the sorted coins separated according to the size in the coin sorting means to a predetermined location;

a coin receiving tube located at an end portion of the guide;

a plurality of tube receiving containers with at least one coin receiving tube having the same size as the coins is equipped in, wherein the tube receiving container is provided for a specific type of the coin receiving tube respectively; and a sliding member located under the tube receiving containers, for moving the tube receiving container back and forth respectively.

* * * * *